United States Patent [19]

Harpole

[11] 4,186,680

[45] Feb. 5, 1980

[54] SAIL ASSEMBLY

[76] Inventor: George B. Harpole, 3905 Rolling Hill Dr., Middleton, Wis. 53593

[21] Appl. No.: 871,805

[22] Filed: Jan. 24, 1978

[51] Int. Cl.[2] ..... B63H 9/06

[52] U.S. Cl. ..... 114/103; 24/249 R; 244/DIG. 1; 244/153 R

[58] Field of Search ..... 114/102, 103, 39, 43, 114/90; 244/DIG. 1, 153 R, 16; 24/249 R

[56] References Cited

U.S. PATENT DOCUMENTS

| | | | |
|---|---|---|---|
| 3,615,064 | 10/1971 | Gellert | 244/153 R |
| 3,858,542 | 1/1975 | Lenoble | 114/39 |
| 3,920,201 | 11/1975 | Battles | 244/16 |

FOREIGN PATENT DOCUMENTS

| | | | |
|---|---|---|---|
| 220714 | 4/1942 | Switzerland | 24/249 R |
| 1070667 | 6/1967 | United Kingdom | 244/DIG. 1 |

*Primary Examiner*—Sherman D. Basinger
*Attorney, Agent, or Firm*—Keith Schoff

[57] ABSTRACT

A skate sail is rigged with leading edge spars set by manipulation of a cruciform frame. The sail and frame assembly is suitable for mounting on a boat or vehicle as well as for being hand held, and is collapsible for compact stowing. When provided with a cinch line the sail assembly can be used for hang gliding. Rigging is set by joining separable lengths of a mast and advancing a transverse brace along the mast toward the mast head to deploy by toggle-like action head spars to which the sail is lashed thereby spreading and drawing taut a trapezium configuration of sail foil which is anchored to the foot of the mast. Laterally extendable wings may be provided and deployed separately to provide troughs which catch air spilling from the main sail foil and ease handling of the sail and enhance the ability of a user to trim the sail readily.

5 Claims, 6 Drawing Figures

SAIL ASSEMBLY

BACKGROUND OF THE INVENTION

Portable frame-and-sail assemblies are widely used for skate sailing and hang gliding, and are used for small boat, iceboat and land vehicle sailing. Such assemblies characteristically comprise a multiple number of full width spars, i.e. one at the leading edge, one near the lift center for being manually grasped, and sometimes one at the foot of the sail. Unlike kites, parachutes or sails used only for running with the wind, a sail for running cross-wind or to windward, possibly at speeds of from two to three times wind velocity, is required to be rigged with the leading edge stayed for damping vibration, a non-pliant member such as a mast being used if possible, and if not, then a tautly stretched, strongly anchored stay line as may be used for a jib. A skate sail, which is manually held at an oblique angle during use, is optimumly provided with a head spar. Whether the sail is tensioned tautly for running close to the wind or is provided with slack for running with the wind, a simple cruciform frame sufficiently stout to provide adequate anchorage for rigging a stay line proves excessively heavy for use in a skate sail, in which weight is a factor limiting the ability and endurance of a skater to support and manipulate a sail assembly. Reducing the number and size of framing members in a skate sail to enable use to be made of fewer, shorter and thinner members increases the serviceability of a sail for such use.

SUMMARY OF THE INVENTION

A light weight, multi-purpose sail assembly is framed conveniently with short, separable components of minimal collective length, including a single full sail width transverse member, a weather edge spar which is jointed at the mast head and buttressed midway along each jointed section on either end of an abbreviated length stiff brace which is set cruciform with a mast along which it is run and snugged or latched to deploy the spar sections by toggle-like action and spread the sail. A trapeziform sail is stretched tautly from an anchor point at the foot of the mast unless deployment of the spar sections is restrained by a cinch line as used when the sail assembly is rigged for hang gliding. Triangular pieces may be attached to the sides of a trapeziform sail and be separately deployed by retractable spring wires to provide wind-spill troughs for the purpose of increasing the stability and ease of handling of the sail assembly by a skater. For stowage, the mast may be dismantled into sections and placed together with the cross-brace and closed spar arms into a compact size with the folded sail. The sail assembly provided by this invention is lighter in weight and more serviceable that those assemblies which comprise longer collective frame member lengths, and can be expanded for ease of handling in varying wind conditions.

DESCRIPTION OF THE INVENTION

Figure 1:
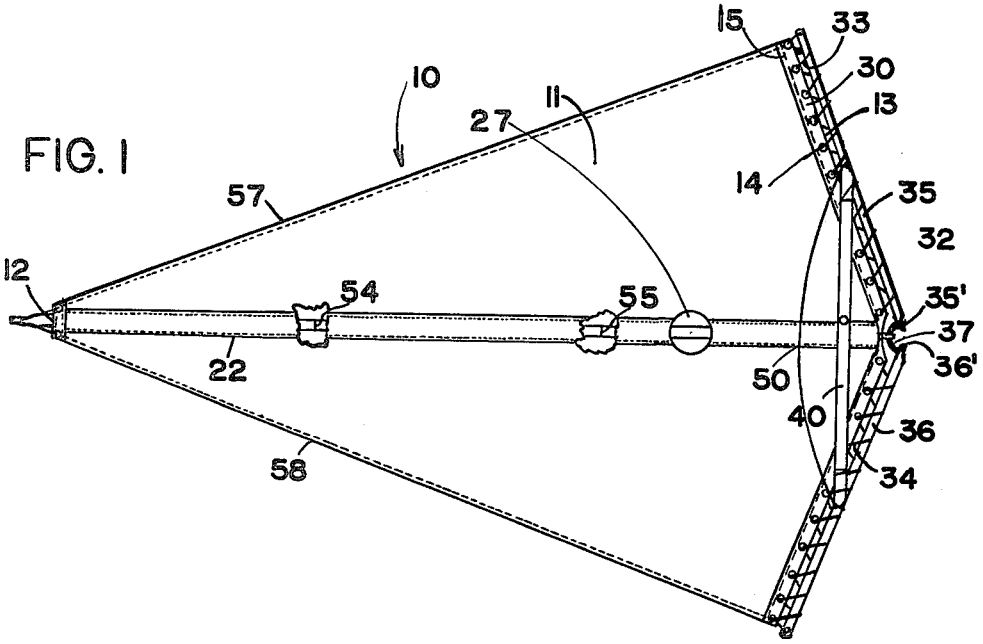
FIG. 1 is a side elevation of one embodiment of a skate sail assembly of this invention.
Figure 2:
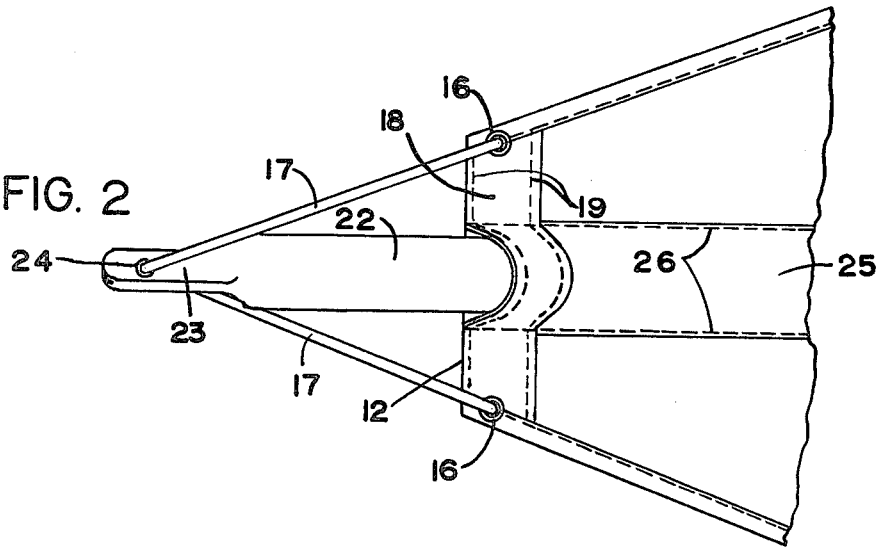
FIG. 2 is an elevation of the detail of the foot edge of the sail assembly embodiment of FIG. 1.

In FIG. 1 sail assembly 10 is shown comprising sail 11 tautly attached at foot edge 12 and head edge 13, respectively, by line 17 laced through grommets 16 at the foot corners of sail 11 and through eye 24 at the foot of mast 22, and by lines 33 and 34 laced through grommets 14 and around spar sections 35 and 36 which form the leading edge stay for sail 11. In FIG. 2 foot edge 12 is shown strengthened by reinforcing tape 18 sewed with two rows 19 of single stitches across the foot of the sail and under grommets 16. The foot of mast 22 is shown flattened and sealed to prevent water or debris from entering into the core of the tubular mast. Sleeve 25 is shown disposed along the center line of sail 11 enclosing mast 22 and comprises narrow elongated patches of sail cloth fastened to sail 11 by two rows of stitching along its length with hand-hold 27 interspersed to enable a skater to operably grasp and manipulate mast 22, the skater being positioned on the lee side of sail 11 protected from the wind and in position to rest mast 22 on his shoulder to relieve the load of manually holding the sail assembly aloft. In tacking, sail assembly 10 is shifted by the skater to his opposite side, the skater always remaining on the same side of the sail assembly, however, to enable him to grasp the framing members.

Head edge 13 of sail 10 is shown reinforced with tape 30 attached by the rows 15 of single stitching and provided with grommets 14 spaced at about three inches for lacing lines 33, 34. Toggle spars 35, 36 are lightweight members, preferably aluminum alloy tubing, around which lines 33 and 34 are laced for closely drawing sail 11 into proximity against the restraint of lace 17 at the foot of mast 22. The toggle spars form a non-pliant weather edge reinforcement for sail assembly 10. Inner ends 35', 36' of spars 35, 36 are shown attached to the head of mast 22, each such member being configured with a flattened end extremity through which an eye is provided with line 37 passed therethrough and knotted at the ends to provide a hinge. If desired, spars 35, 36 may be unconnected either to the mast or to each other without detriment to use of sail assembly 11, however, such lack of connection lessens the stability and rigidity of the weather edge of the sail assembly.

Figure 3:
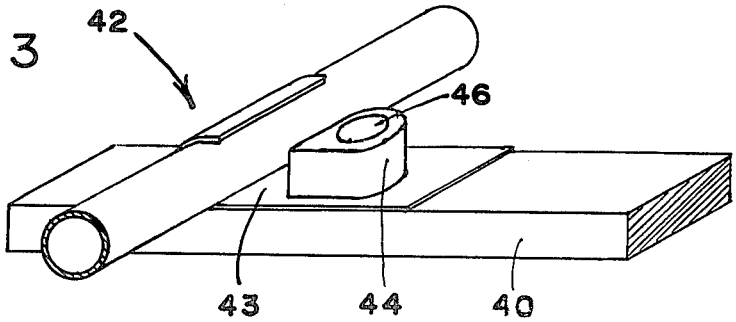
FIG. 3 is a perspective view of a latch for fastening together the mast and the cross brace members of the embodiment of FIG. 1.
Figure 5:
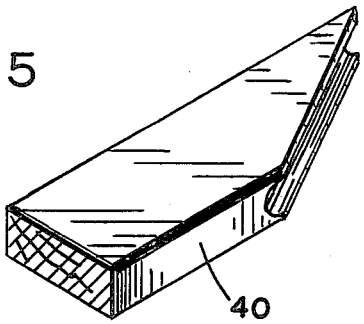
FIG. 5 is a perspective view of one end of the brace member of FIG. 1.

Brace 40 is shown cruciform with mast 22 and of lesser length than the width of sail 11 at its upper portion, and is preferably less than the mean width of sail 11. The end extremities of brace 40 are cleaved or deeply grooved, as shown in FIG. 5, to slidably cradle and support the tubing configuration of the mid-portions of spars 35, 36. Any other operable configuration may be used such as pivotal or roller means, but such means are not preferred. Brace 40 is preferably non-pliant, but stiffly deformable to resiliently urge spars 35, 36 into depolyment when the brace is advanced along mast 22 and secured in position by latch 42 carried on brace 40. Wood or glass fiber structure is preferred material for brace 40, and of such dimension as best shown in FIG. 3 with the width dimension of the elongated brace in the plane of the sail being greater than that which is transverse to the plane of the sail to provide bending stiffness to the member for deploying spars 35, 36. Latch 42 is shown configured with hook shaped metal plate 43 secured to brace 40 and provided with bolt 46 about which rotatable rubber cam 44 is fitted. When brace 40 is properly positioned with respect to spars 35, 36, it is drawn up along mast 22 toward the shead of the mast until a bending moment is evident by there being a resilient restoring force felt which resists further drawing of the brace up the mast, whereupon cam 44 is rotated to the position shown in FIG. 3 to frictionally secure brace 40 in the desired position relative to mast 22. Sail 11 is tautly stretched by spars 35, 36 being deployed by brace 40 unless cinch line 50, shown slack in FIG. 1, is foreshortened to limit outward deployment of spars 35, 36. Cinch line 50 is employed to limit the movement of spars 35, 36 only when sail assembly 10 is used as a hang glider.

Mast 22 is preferably fabricated from telescopingly fitted or otherwise separable or collapsible sections of aluminum alloy tubing, joints 54, 55 being shown for facilitating convenient disassembly and compact stowing of sail assembly 10.

Leech edges 57, 58 of sail 11 are shown hemmed only in FIG. 1, however, they may be reinforced and fitted with stay lines in the manner conventional for sail, if desired. Sail 11 is conveniently fabricated from a retangular bolt of sail cloth by cutting the cloth diagonally on the bias and sewing the bias edges together, the seam lying along the length of mast 22, with all outer edges of sail 11 being free of bias cut fabric.

The provision of abbreviated length brace 40 disposed as a toggle-like operator for spars 35, 36 reduces the collective length of all frame members of sail assembly 10 to less than that for sail assemblies which are equipped with a brace of full length of the transverse axis of the sail, and because of the shorter length of brace 40 and the shorter unsupported reach spanned by spars 35, 36 than for spars which are end-supported, the section diameter and weight of brace 40 and of spars 35, 36 can be diminished relative to similar members of longer reach and span without sacrifice in structural strength of the framing, thus providing an optimumly serviceable and efficient sail assembly.

Sail 11 may be provided with hemmed edges to form enclosing sleeves for receiving spars 35, 36 rather than being provided with lacing as shown, but such sleeves are not preferred because the sail fabric tends not to be as uniformly tensioned as when lashed to the spars by lacing. Cinch line 50 is eliminated from sail assembly 10 if the sail assembly is not used for hang gliding, and sleeve 25 may be eliminated from the sail assembly, if desired.

Sail assembly 10 may be mounted on a boat, iceboat, bicycle or other land vehicle for use without being hand-held while the advantage of the sail assembly being of lower profile than are conventional sails and thus having greater stability against tipping or capsizing, is retained.

Figure 4:
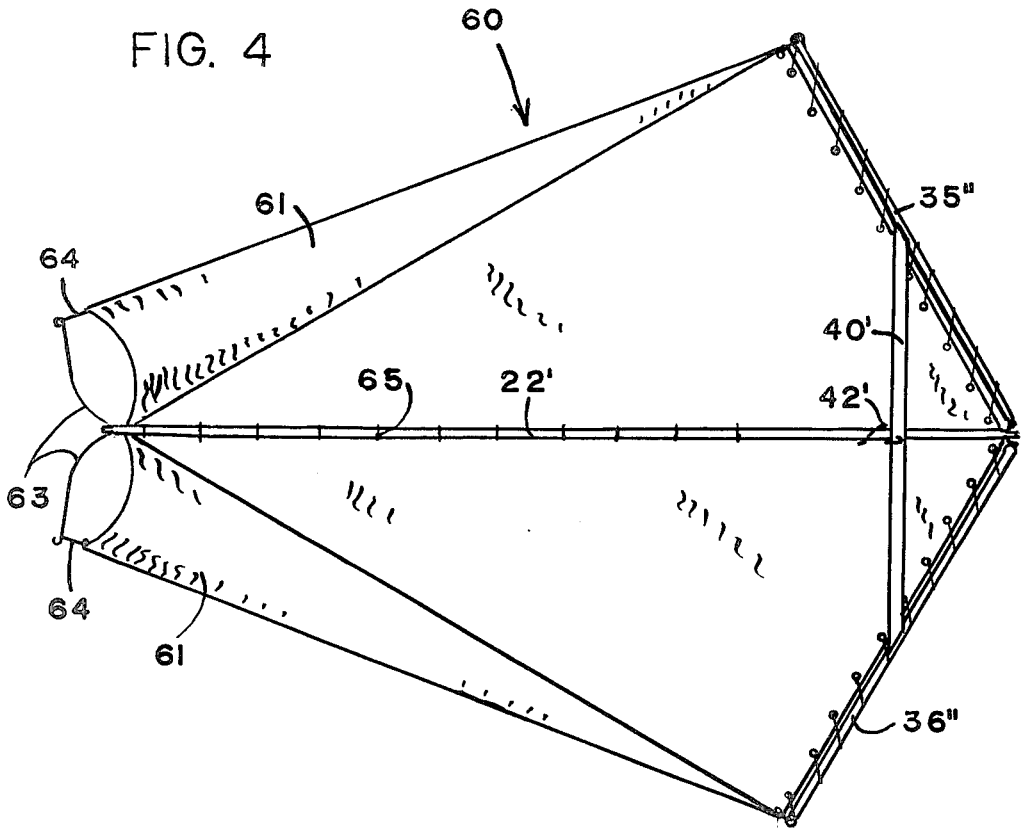
FIG. 4 is a side elevation of another embodiment of a skate sail embodiment of this invention.
Figure 6:
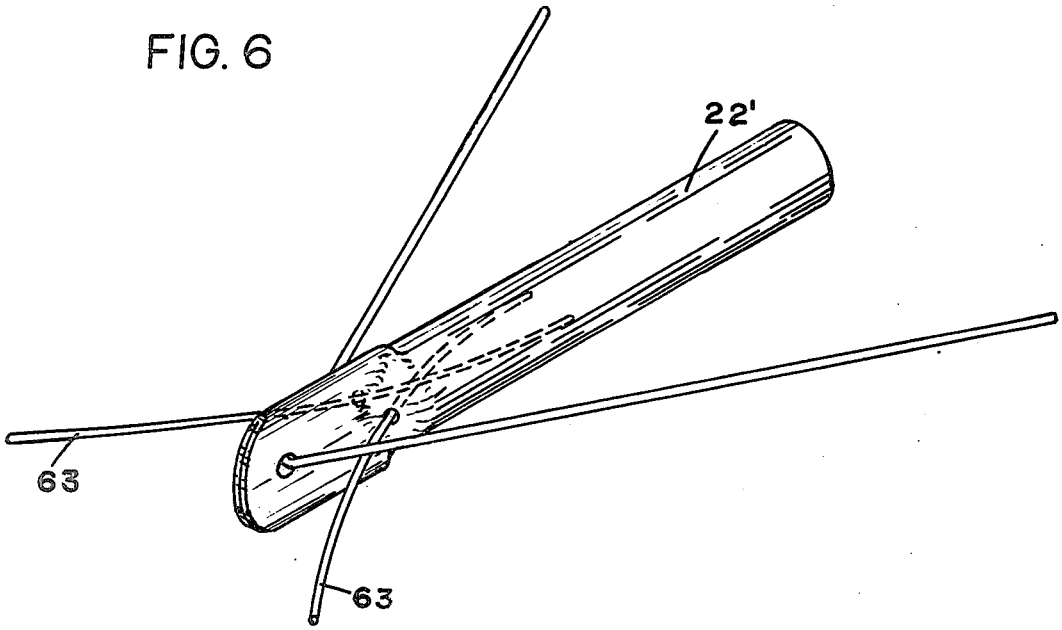
FIG. 6 is a perspective view of the foot of the mast of FIG. 4 showing, in broken line representation, portions of spring vires disposed within the mast.

In FIG. 4, sail 60 is shown stretched in the manner of sail 11 of FIG. 1 from the foot of mast 22′ to spars 35″, 36″, however, triangular portions 61 sewn on the sides of trapezium portion 11′ of sail 60 are not stretched laterally as shown and are free to billow to form troughs or gutters for wind spilling from sail portion 11′. Spring wires 63, which preferably comprise one-eighth inch diameter piano wire, retractably project from two openings in opposite sides of mast 22′ for being manually extended or inserted with the exposed end extremities of the wires being fitted with cords 64 which attach to the free corners of triangular sail portions 61, thereby enabling the outer edges of sail portions to be tensioned without the foot edges of the sail portions being drawn taut. Sail portions 61 are therefore enabled to form wind spill troughs unless wires 63 are fully extended whereby the sail portions 61 are tautly stretched, but may be disposed in planes angularly set from the plane of main portion 11′ of sail 60. The inner end extremities of spring wires 63 disposed within tubular mast 22′ are shown in broken line representation in FIG. 6, the detail of the foot of mast 22′ being similar to that shown in FIG. 2: as shown in FIG. 6 the spring wires are fully extended and will reach farther along the bore of the mast when they are manually inserted either to stow the apparatus or to reduce the distance to which he wind spill troughs are extended. The provision of wind spill troughs facilitates handling of the sail assembly by cushioning the effect of wind spilling from sail portion 11′ in a manner which creates a force disrupting the balance of the sail assembly in the wind, and eases handling of the sail in tacking and trimming. Additionally, in light breezes full extension of wires 63 effectively increases the sail area materially, e.g. using a ten foot long mast a sail may conveniently be increased from forty-one square feet to fifty-seven by use of sail portions 61.

Sail 60 is secured to mast 22′ by lacing 65, as shown in FIG. 4, rather than being enclosed in a sleeve as in FIG. 1; either expedient proves suitable for use. Latch means 42′ consists of a stout length of rubber or synthetic resin coated wire configured with one helical turn about mast 22′ and a hook shaped upper extremity for receiving brace 40′. When snugged in position to properly tension brace 40′ against spars 34″, 36″, latch 42′ is frictionally retained from sliding on mast 22′ in operable manner.

For economy of material usage in fabricating sail 60 the side apexes of both sail portion 11′ and triangular portions 61 are of right angular configuration thus providing a pattern which permits use to be made of all material in a bolt of sail cloth. In use, sail portion 11′ is tautly stretched planarly at all times whereas triangular portions 61 are tautly stretched in one direction only when used as spill troughs and may be tautly stretched in the plane of sail portion 11′ as desired, but the flexibility of spring wires 63 enables portions 61 when so stretched to yield rather readily and assume an angular disposition relative to sail portion 11′ whereas sail portion 11′ is firmly retained in planar configuration by the stiffness of mast 22′ and brace 40′. Spring wires 63 may comprise any suitable material such as resin bonded fibrous glass rods.

I claim:

1. A sail assembly comprising, a. a sail, b. a mast disposed substantially coincident with one diagonal of said sail, c. a brace cruciform with said mast, said brace being non-pliant, shorter, and disposed non-coincident with one cross diagonal of said sail, and wherein the end extremities of said brace are configured with groove-like recesses, d. latch means for adjustably securing said mast to said brace, e. relatively non-pliant spars, disposed individually along two edges of said sail which form a common juncture with said one diagonal, said spars being moveably retained upon either end extremity of said brace in said groove-like recesses, said brace urging said spars outward for deploying said sail, said sail being fixed to said spars and anchored to the foot of said mast.

2. The apparatus of claim 1 wherein said sail is trapeziform.

3. The apparatus of claim 1 wherein the foot of said said extends substantially laterally from the foot of said mast and wherein resilient spring means are retractably disposed in the foot of said mast to spread the foot of said sail.

4. The apparatus of claim 1 wherein a cinch line is affixed to each said spar for being foreshortened to limit outward biasing of said spars by said brace.

5. The apparatus of claim 1 wherein said sail is configured with a trapezium main body and symmetrically placed triangular sail extensions which can be spread from the foot of said mast.

* * * * *